United States Patent [19]

Bridges

[11] 4,160,570

[45] Jul. 10, 1979

[54] WALL MOUNTED MODULES FOR PACKAGING, MERCHANDISING AND STORAGE

[75] Inventor: John A. Bridges, Nashville, Tenn.

[73] Assignee: Aladdin Industries, Incorporated, Chicago, Ill.

[21] Appl. No.: 874,865

[22] Filed: Feb. 3, 1978

[51] Int. Cl.[2] ..... A47F 3/14; A47F 5/08

[52] U.S. Cl. ..... 312/245; 108/32; 206/45.14; 206/373; 211/69; 211/88; 220/18

[58] Field of Search ..... 312/245; 211/60 T, 88, 211/90, 71, 126, 69; 108/27, 32, 152; 220/4 F, 4 E, 18, 4 B, 4 D; 206/45.14, 45.19, 379, 372, 373, 44 R

[56] References Cited

U.S. PATENT DOCUMENTS

| | | | |
|---|---|---|---|
| 2,086,300 | 7/1937 | Moffa | 206/419 |
| 2,788,123 | 4/1957 | Levis et al. | 206/45.19 |
| 2,936,879 | 5/1960 | Downs | 206/45.19 |
| 3,298,531 | 1/1967 | Wilcke | 211/60 T |
| 3,381,636 | 5/1968 | Saiberlich | 108/152 |
| 3,734,526 | 5/1973 | Probst et al. | 248/224.3 |
| 3,791,528 | 2/1974 | Brendgord | 211/126 |
| 3,983,976 | 10/1976 | Taylor | 220/18 |

*Primary Examiner*—Mervin Stein
*Assistant Examiner*—Alex Grosz

[57] ABSTRACT

Modular units for packaging articles to be sold in stores, used to display the articles for sale and which may then be used for storage and easy accessibility in use of the articles by purchasers. The modules are formed of two relatively thin plastic pieces. The pieces are joined together to form a hollow structure with an upper article supporting surface. One or more article holding elements such as recesses or depressions are provided in the upper surface while means are provided on the back of the modular unit whereby it can be mounted on a vertical surface when the articles are displayed for sale, and while being stored for a purchaser and awaiting usage. A protective cover can be provided to permit safe transport of the articles and/or for protection while being displayed and/or stored.

16 Claims, 7 Drawing Figures

WALL MOUNTED MODULES FOR PACKAGING, MERCHANDISING AND STORAGE

BACKGROUND OF THE INVENTION

This invention relates generally to article holding devices. More specifically it relates to devices for holding articles to be merchandised and/or stored for later use.

There are many patents disclosing structures for the display and storage of articles which are intended to be mounted on vertical supporting surfaces. Those of which the applicant has knowledge fall into two different categories. The first of these may be defined as being of the bin type intended to hold loose parts or parts in small packages in an unorganized fashion. Such devices are shown in U.S. Pat. Nos. 2,702,649, 2,730,263, 3,203,558, 3,252,614, 3,563,394, 3,661,271, 3,698,565, 3,734,526 and 3,791,528. The devices of each of these patents, whether intended merely for the storage of parts in factories or service shops or for use in the home or for the display of parts to be sold, are nothing more than simple bins for holding loose parts or small parts held in packages. To the extent that any one of them is proposed for use or could be used as a merchandising device, they deal with only one aspect of merchandising to some degree, namely, of storage. They do not at all deal with the importance of attractive packaging and presentation to a potential customer. In fact, they do not deal at all with convenience in all of its aspects.

With respect to the first point, the failure to deal with the presentation of the articles to be sold, the bin does no more than afford a helter-skelter display of the articles, whether they be small hardware items such as screws, nuts, bolts, washers or the like; larger hardware items of the hand tool variety such as screwdrivers or wrenches; sewing items such as thread, bobbins, scissors and the like; or cosmetic items such as lipstick, fingernail polish; and food items such as spices. It is well known that the appearance of a display of articles for sale is an aid in the sale of the articles. An orderly arrangement of articles permits a purchaser to see clearly what he is buying, will be convenient to store and use, and provides him, in the case of the small quantity purchaser, with a visible assortment of items in which he is interested. The purchaser is going to be attracted to the display and will be more likely to purchase. Bins do not include structure which permits these results.

As for the matter of convenience, the bin type device offers a prospective purchaser convenience in the sense that he may reach into a bin and pull out a package of screws or five nails, or whatever. If that purchaser is interested in an assortment of items of different types and sizes, the bin requires him to go from one bin to another to collect his assortment or to search through a bin picking out what he wants. A bin does not provide means which serve all convenience objectives, particularly as related to an assortment of fasteners, bolts, screws or other small parts.

When used as a storage device the bin suffers from some of the same deficiencies; for instance, it may be perfectly satisfactory for an industrial user to have a bin full of screws of a certain size, for these articles may be used in great numbers. However, a hobbyist or the home workshop enthusiast may not have the space or money to provide separate bins for each item that he may want to use as he builds items or makes repairs in his home. Thus, bins do not treat all of the objectives for merchandising and storing diverse articles.

Another group of patents with which the applicant is familiar are wall mounted units which are of essentially the shelf variety. This group includes U.S. Pat. Nos. 3,033,378, 3,381,636, 3,613,604 and 3,908,831. Shelves, as with bins, from both the merchandising and storage point of view, deal at most with the elements of convenience and flexibility. As merchandising devices, assuming the store employees have done what they are supposed to do, the shelf presents a stock or stocks of articles to be sold. They do not compel an organized display of an assortment of related or identical articles for they simply provide a flat space on which articles can be put and depend upon store employees.

Molded cases for various hand tools are well known and serve primarily the transport and storage functions, but do not address the merchandising display function or the convenient access function.

As described, many known devices provide attractive merchandise display or provide for safe and convenient transport or provide for storage in the home or provide for easy use and access, but none are known which provide for all of these functions in one unit. The modules described in this application easily fulfill all these needs in an inexpensive, orderly and convenient way.

Therefore, it is an object of this invention to provide novel modular units which can be movably or removably mounted on vertical surfaces, and include means for attractively and conveniently presenting articles to be sold as sets.

Another object of this invention is to provide novel modular units which can be used to attractively display articles for merchandising purposes and which may also be used by purchasers as convenient storage for the articles until their use is desired and easy access to the articles when they are to be used.

A still further object of this invention is to provide novel modular units which are relatively economical to manufacture and yet have sufficient mechanical strength to permit their extended use as merchandising display devices and/or permanent storage of the article or articles contained in them.

A still further object of this invention is to provide novel modular units which can include means to protect against pilfering while holding articles intended for sale in a store and to also protect against the entry of dust and dirt.

Still another object of this invention is to provide novel modular units which can attractively display articles intended for sale, store those articles at the point of usage and is also provided with means whereby the articles can be conveniently transported by a purchaser from the store to the point of usage.

Still another object of the invention is to provide novel modular units which can be conveniently transported by the purchaser from his point of storage to his point of use (assuming that it is different from his point of storage) through the unique shape of the module and its cover, thereby forming a carrying case as well as a storage module.

BRIEF DESCRIPTION OF THE DRAWINGS

The invention itself is set forth in the claims appended hereto and forming a part of this specification. While an understanding of the embodiments thereof may be had by reference to a detailed description taken in conjunction with the drawings in which:

DETAILED DESCRIPTION

Figure 1:
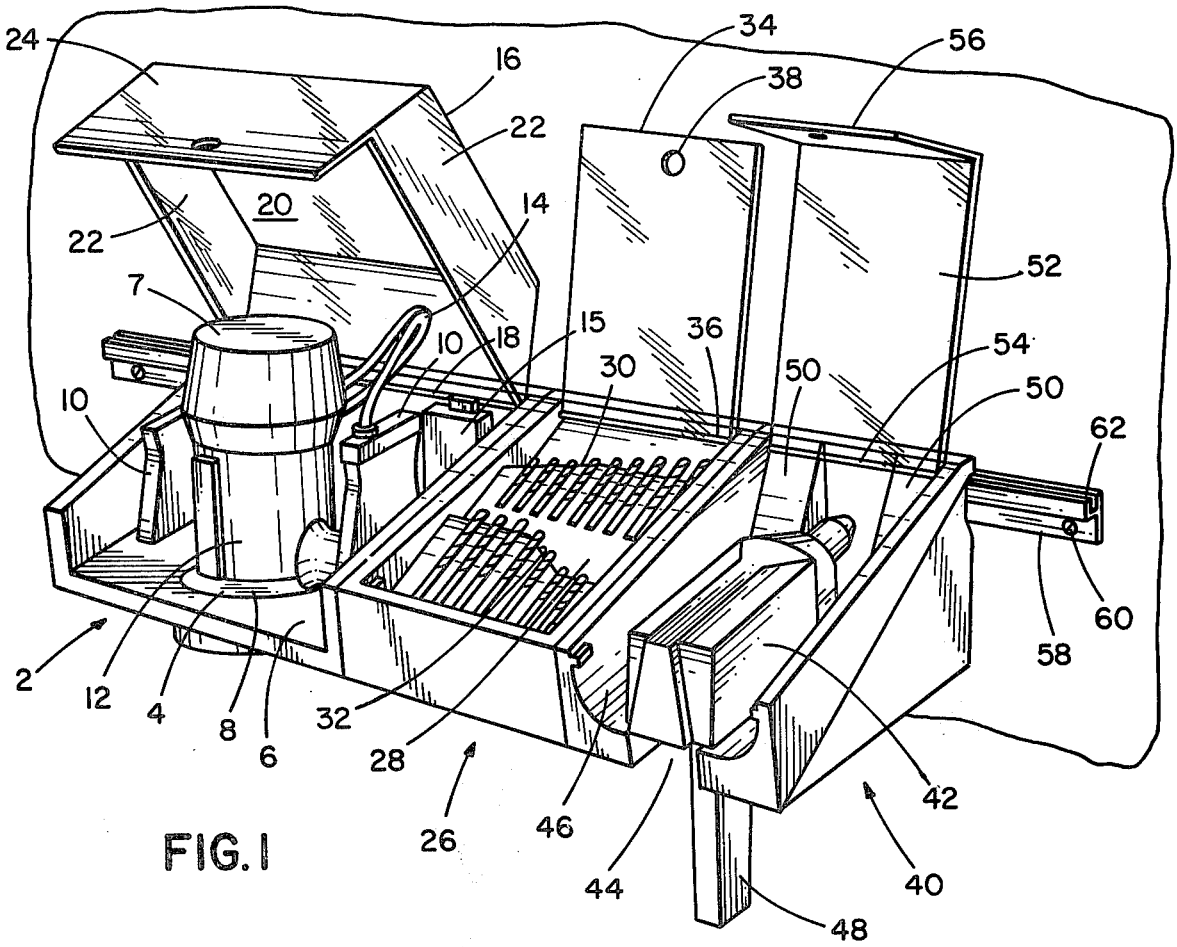
FIG. 1 is a perspective illustration of various embodiments of the invention.

FIG. 1 illustrates three embodiments of merchandising display and storage modules in accordance with the invention. Generally each such module comprises upper and lower sections preferably made by vacuum forming or injection molding a plastic material to have relatively thin walls (see FIG. 3). The upper and lower sections are joined together so that the resulting module is a lightweight hollow structure, but is one having sufficient mechanical strength to support itself and the articles it carries when mounted on a vertical supporting surface. Such strength could not be accomplished with a one piece construction of equal weight. Each module includes one or more recesses, receptacles, openings or guide elements to hold articles being displayed and/or stored. In accordance with the invention, if desired, a protective cover may be provided to shield the articles while on sale or while being stored by a purchaser before use.

In FIG. 1, one module 2 is formed with a round receptacle 4 in a transversely extending portion 6 of its upper surface to receive and hold a router 7 in position. The router has a bottom 8 extending into the receptacle 4 and is provided with handles 10 and a housing 12 for the motor. As may be seen, the module 2 is formed to be of a sufficient width to accommodate the width of the router, including its handles. In addition space may be provided to accommodate an electric power cord 14 and a box 15 holding cutting tools to be inserted into the router.

In order to protect the router during the time that it is being displayed for sale or while it is being transported or stored, a cover 20 may be pivotally mounted at 18 in the rear of the module. Because the router is a relatively bulky device and it, and other similar devices, may extend above the level of the unit, the cover can be formed with a flat upper surface 21 and downwardly depending sides 22. A front of the cover 24 extends further than the sides 22 so that when the cover is closed the router will be completely enclosed. The cover may be formed of any suitable transparent plastic material to permit a purchaser to visibly inspect the article in the module while it is on sale. For further protection the cover may be provided with a suitable securing means (not shown) to seal the cover closed while displayed in a store in order to discourage pilfering.

Also shown in FIG. 1 is another module 26 in accordance with the invention. In this module the upper article supporting surface 28 is formed with two rows of recesses 30 and 32 to accommodate an assortment of drill bits in various sizes. As may be seen, the upper surface 28 may be formed at an angle to the horizontal to permit the display of all of the drill bits in the set and also to permit easy access to each drill bits. In the case of the module 26, where the articles held in the module do not extend above its upper surface, the cover 34 need only be a flat element hinged at 36 and movable from an open to closed position. If desired an opening 38 may be provided in a cover to permit it to be relatively easily closed or opened.

A module 40 in FIG. 1 is designed to accommodate a hand held tool such as a power drill 42. In this case the module may be formed with an opening 44 extending from its upper surface 46 all the way through the body of the module and, as may be seen, the handle 48 of the drill would extend through that opening. To the extent that they may be desirable or necessary projections or guide surfaces 50 may be molded on the upper surface 46 to provide positioning guide means for the article, in this case the power drill. Again a transparent cover 52 may be provided and hinged at 54 for protection purposes. The cover can be formed with a front piece 56 to completely enclose the drill within the module when the cover is closed.

Modules in accordance with the invention may be constructed as desribed in my copending application Ser. No. 759,067 filed on Jan. 13, 1977 for "WALL MOUNTED MODULAR UNITS" and assigned to the same assignee as is this application. Thus, such modules may be mounted on a supporting member in the form of a transversely extending bar 58 attached to a vertical surface such as a wall or the like in any suitable fashion as, for instance, by screws 60 and provided with an upwardly opening channel 62. As may be seen, the bar or hanger 58 has an extremely simple configuration, thus rendering it economical to manufacture and capable of being attached to almost any kind of vertical surface or wall.

Figure 3:
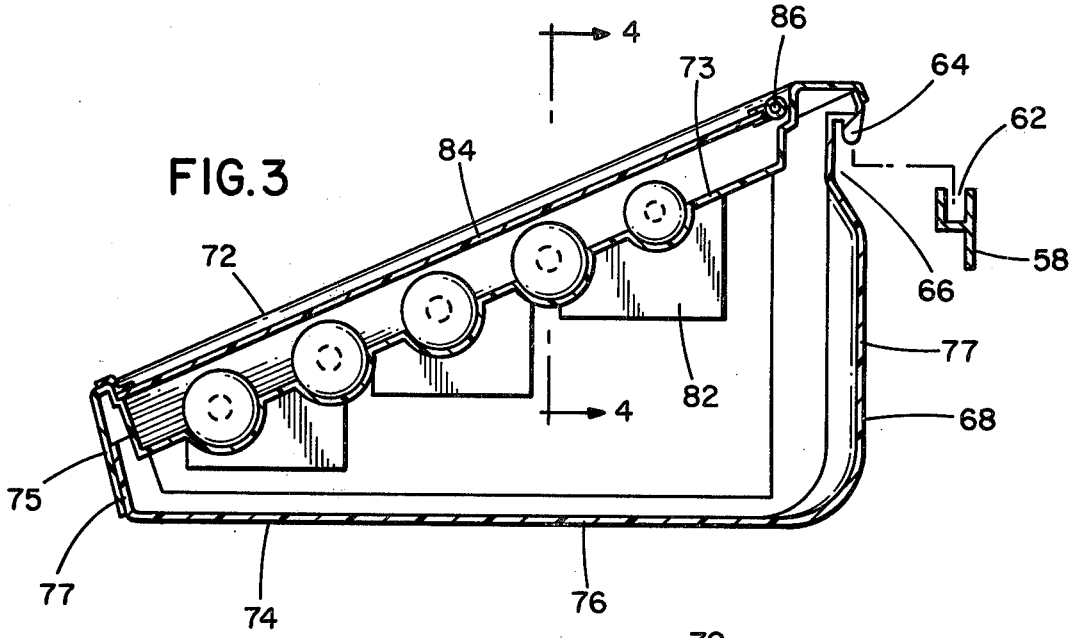
FIG. 3 is a view along the line 3—3 of FIG. 2.

As is best seen in FIG. 3, each module is provided with a portion 64 extending downwardly over a recess 66 formed in the back of the module and spaced from the back wall 68. By virtue of this construction the module may be mounted on the vertical support surface by inserting the portion 64 into the upwardly open channel 62 whereby the channel is accommodated completely within the recess 66 permitting the module to be mounted flush against the supporting surface for both strength and appearance purposes.

The embodiments 2, 26 and 40 serve to illustrate the versatility of the concept disclosed in this application. Thus a router is an example of a hand tool which is relatively bulky and irregular in shape, yet a merchandising display and storage module in accordance with the invention can be designed to accommodate it. Likewise the drills illustrated in conjunction with the module 26 are relatively regular in shape, vary in size, but a fairly complete set of such articles can be accommodated in a very presentable and usable way using the teachings of this application. A hand tool such as the drill 42 can present its own problem, namely, the handle 48 which extends from it. That handle, however, can be accommodated in a module in accordance with the invention. In passing it should be noted that if desired the module 40 could be designed to permit the drill to be laid on its side with the handle 48 extending horizontally.

Figure 2:
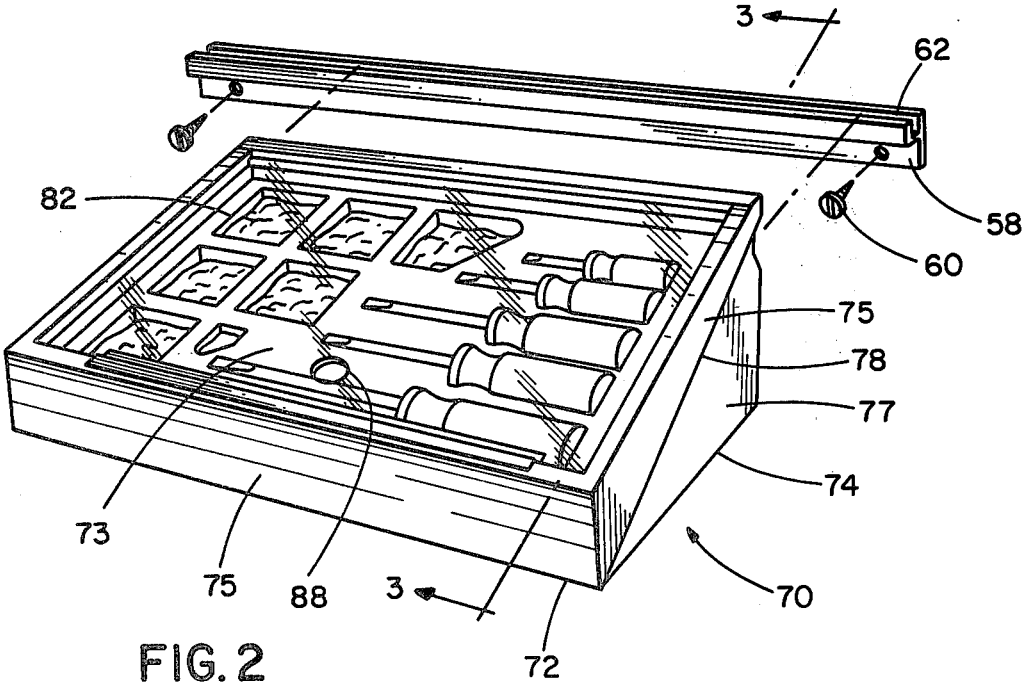
FIG. 2 is a perspective illustration of still another embodiment of the invention.
Figure 4:
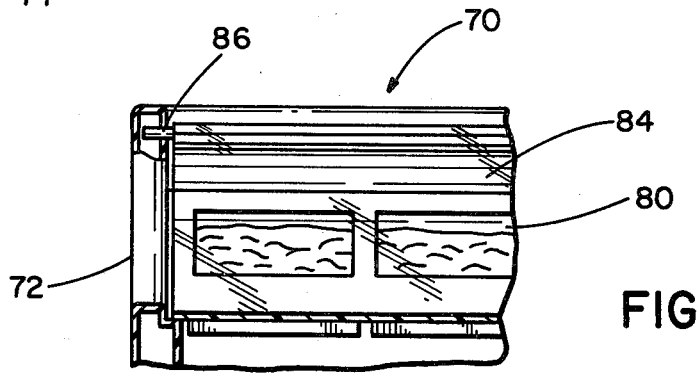
FIG. 4 is a view along the line 4—4 of FIG. 3.

FIGS. 2, 3 and 4 illustrate still another embodiment of the invention. In this embodiment a module 70 once again is formed from upper and lower molded plastic sections 72 and 74, respectively. The upper section 72 includes a top supporting surface 73 and downwardly depending sides 75. The lower section 74 has a bottom surface 76 and upwardly extending sides 77. As is best seen in FIG. 3, the sides of the upper and lower sections are joined along a diagonal seam 78. The upper section supporting surface 73, includes a number of receptacles 80 and 82. As may be seen, the recesses 80 are molded to accommodate the handles and blades of a set of screwdrivers, while the recesses 82 may accommodate screws of different sizes and types. A protective cover, formed if desired out of a transparent plastic, may be provided on the module and hinged at its upper end at 86. A hole 88 can be formed in the cover 84 to permit the cover to be opened as desired. The cover may be molded to fit the upper surface of the parts held therein if desired.

Figure 5:
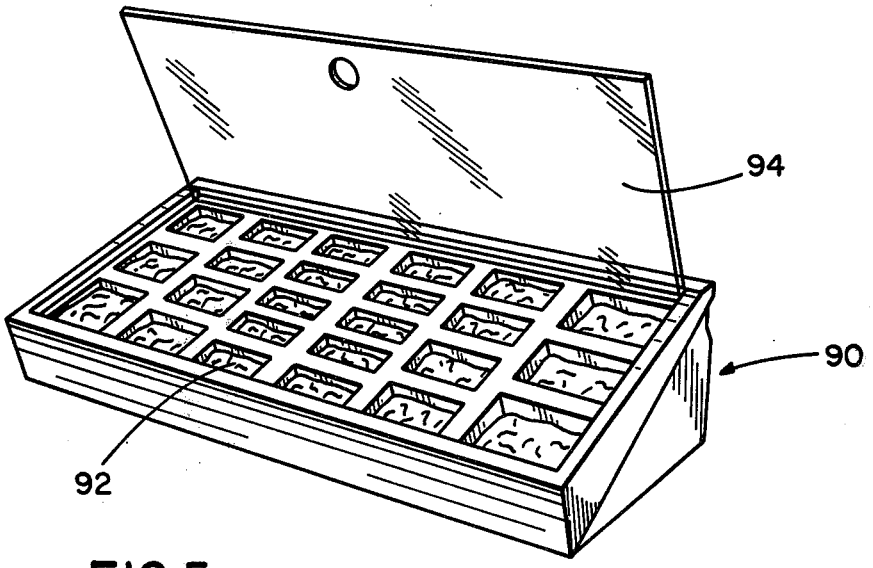
FIG. 5 is a perspective front illustration of still another embodiment of the invention illustrating how a protective cover forming an aspect of the invention may be provided.
Figure 6:
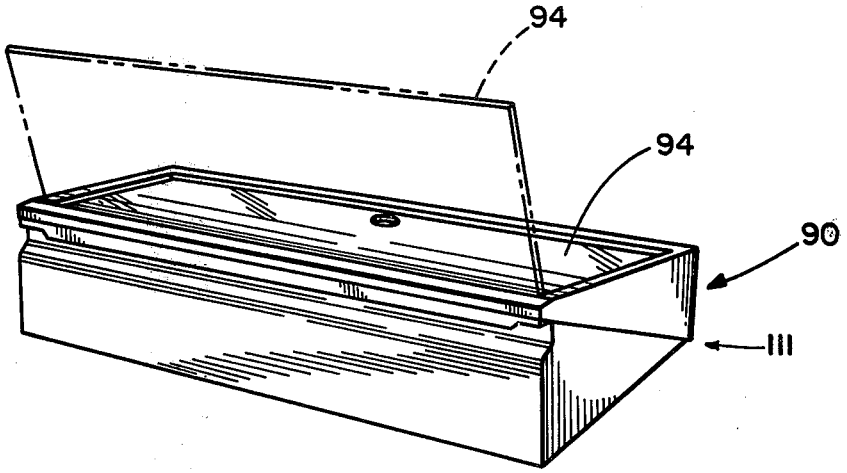
FIG. 6 is a rear perspective illustration of the embodiment of FIG. 5.

In FIGS. 5 and 6 a module 90 has its upper supporting surface formed with a large number of recesses or receptacles 92. Such a module of this design could be used to merchandise a variety of small items such as hardware or sewing items. Once again a protective cover 94 may be provided as described above if desired.

Figure 7:
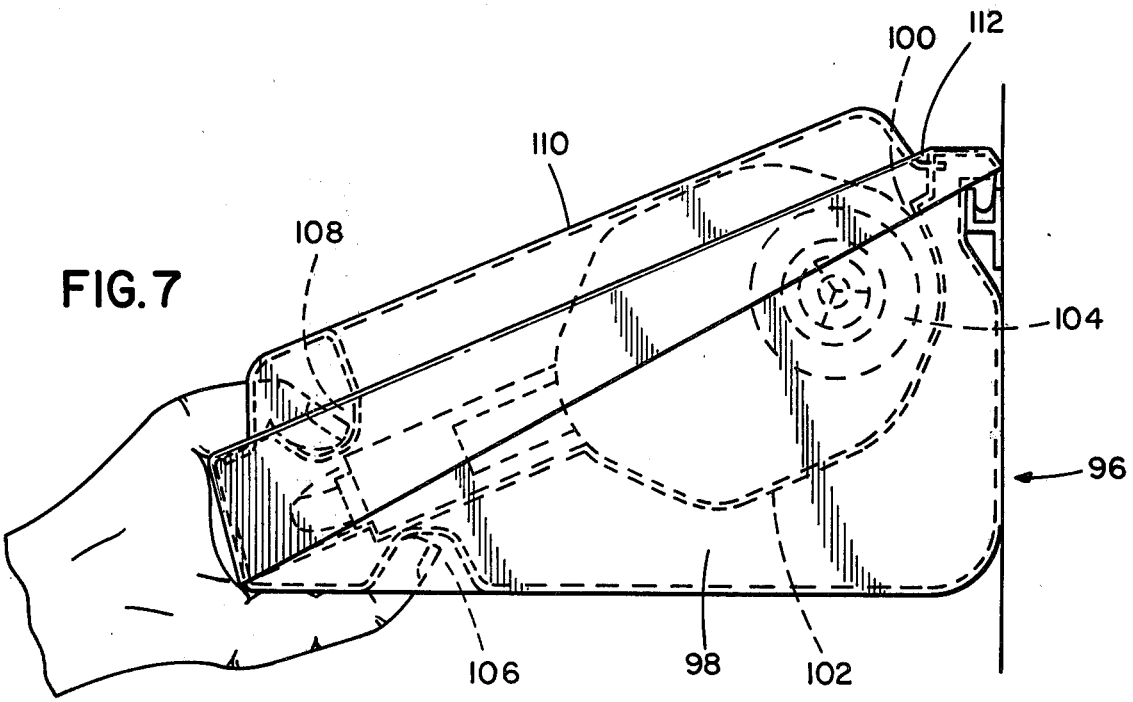
FIG. 7 is a side view of a further embodiment of the invention showing the locking of the cover and the shaped recesses for carrying.

The effectiveness of modules according to this invention can be enhanced by the provision of means permitting them to be used not only as display devices in their merchandising role and as storage devices by a purchaser, but also as packages for the articles which may be conveniently used by a purchaser to carry the article from the place of purchase to the point of storage and/or use. One way of providing such means is illustrated in FIG. 7. In this figure a module 96, once again formed by two molded plastic pieces 98 and 100, provided with a recess 102 in a supporting surface for accommodating an article to be sold, in this instance a hand tool such as a power drill 104. To provide for the use of the module as an article transporting device or carrying case, a first depression 106 is formed in the bottom section 98 while a second depression 108 is formed in a hinged cover 110. The depressions may then be used by anyone to grip the module with the article inside and carry it from one place to another. Means can be provided to insure that the cover 110 remains closed. However, with the depression formed in the cover the cover will remain closed when transported because it is held in the grip of the user. It is therefore not necessary that the module be carried upright with two hands to avoid spilling the contents.

Another embodiment might provide for handgrips at the sides 111 (FIG. 6) which would require two hands and an upright orientation of the module when carrying it.

In this embodiment the cover is illustrated as being a separate piece hinged at 112 to the upper section 100 but it could be formed, using blow-molding, as a unitary assembly with the upper section connected to that upper section by a living hinge.

In describing the various embodiments thereof a number of alternative design details have been shown and described while others have been proposed. It is recognized that in actual use, considering the wide variety of articles purchased by people, that there can be many variations in the shape, position and number of receptacles, recesses, openings and positioning elements provided in the modules. In addition, other design features such as the materials used, the provision and arrangement of protective covers and the manner in which they are included with the modules can be varied. Therefore, it is intended by the claims appended hereto to cover all such variations in design and materials as come within their scope.

What is claimed as new and desired to be secured by Letters Patent is:

1. A merchandising display and storage module comprising a hollow structure constituted by upper and lower sections, said upper section having an exposed transverse display portion and side walls around the periphery thereof extending downwardly therefrom, said lower section having a transverse portion and side walls around the periphery thereof extending upwardly therefrom, the confronting side walls of said upper and lower sections on each side of the unit being attached to each other to form a hollow structure having a top, bottom and side walls, said upper section having at least one element formed on said transverse display portion shaped to encompass at least a portion of an article to be displayed and stored, means formed in one side wall of the unit for mounting the unit on a vertically extending supporting surface and a transparent cover extending substantially over said transverse portion.

2. The merchandising display and storage module of claim 1 wherein said cover is movably hinged on the module.

3. The merchandising display and storage module of claim 2 including means for engaging said cover to open and close it.

4. The merchandising display and storage module of claim 1 wherein the said transverse portion of said upper section is provided with a plurality of article holding elements.

5. The merchandising display and storage module of claim 1 wherein said at least one article holding element is constituted by a recess in said transverse portion of said upper section.

6. The merchandising display and storage module of claim 1 wherein said module is provided with a plurality of recesses in said transverse portion of said upper section.

7. The merchandising display and storage module of claim 6 wherein said recesses have different dimensions.

8. The merchandising display and storage module of claim 1 wherein said article holding element is constituted by an opening extending through the module.

9. The merchandising display and storage module of claim 1 wherein said means for mounting the module on a vertically extending surface comprises a continuously horizontally extending recess formed in the back side wall of the module and a portion extending downwardly over said recess for engagement in a support mounted on said vertically extending surface and having an upwardly opening continuous horizontal channel whereby the module may be selectively positioned along the channel.

10. The merchandising display and storage module of claim 1 wherein said at least one article holding element is constituted by a recess in said transverse portion of said upper section.

11. The merchandising display and storage module of claim 10 wherein said module is provided with a plurality of recesses in said transverse portion of said upper section.

12. The merchandising display and storage module of claim 11 wherein said recesses have different dimensions.

13. The merchandising display and storage module of claim 12 wherein said means for mounting the module on a vertically extending surface comprises a recess formed in the back side wall of the module and a portion extending downwardly over said recess for engagement in a support mounted on said vertically extending surface and having an upwardly opening channel.

14. The merchandising display and storage module of claim 1 wherein said article holding element is constituted by an opening extending through the module.

15. The merchandising display and storage module of claim 1 wherein said means for mounting the module on a vertically extending surface comprises a recess formed in the back side wall of the module and a portion extending downwardly over said recess for engagement in a support mounted on said vertically extending surface and having an upwardly opening channel.

16. The merchandising display and storage module of claim 1 wherein said at least one article holding element is shaped to conform substantially to a configuration of an article or articles to be held therein.

* * * * *